US009525931B2

(12) United States Patent
Wiggins

(10) Patent No.: US 9,525,931 B2
(45) Date of Patent: Dec. 20, 2016

(54) PLAYBACK BASED ON RECEIVED SOUND WAVES

(71) Applicant: Sonos, Inc., Santa Barabara, CA (US)

(72) Inventor: Daniel C. Wiggins, Montecito, CA (US)

(73) Assignee: Sonos, Inc., Santa Barbara, CA (US)

( * ) Notice: Subject to any disclaimer, the term of this patent is extended or adjusted under 35 U.S.C. 154(b) by 96 days.

(21) Appl. No.: 14/584,680

(22) Filed: Dec. 29, 2014

(65) Prior Publication Data

US 2015/0110293 A1 Apr. 23, 2015

Related U.S. Application Data

(63) Continuation of application No. 13/601,519, filed on Aug. 31, 2012, now Pat. No. 8,956,033.

(51) Int. Cl.

| | |
|---|---|
| ***H04R 1/20*** | (2006.01) |
| ***H04R 1/34*** | (2006.01) |
| ***H04R 1/02*** | (2006.01) |
| *H04R 1/24* | (2006.01) |
| *H04R 1/26* | (2006.01) |
| *H04R 1/40* | (2006.01) |
| *H04R 5/02* | (2006.01) |
| *H04R 5/04* | (2006.01) |

(52) U.S. Cl.

CPC *H04R 1/20* (2013.01); *H04R 1/02* (2013.01); *H04R 1/345* (2013.01); *H04R 1/023* (2013.01); *H04R 1/24* (2013.01); *H04R 1/26* (2013.01); *H04R 1/403* (2013.01); *H04R 5/02* (2013.01); *H04R 5/04* (2013.01); *H04R 2201/34* (2013.01); *H04R 2420/07* (2013.01)

(58) Field of Classification Search

CPC ..... H04R 2430/01; H04R 2430/21; H04R 2499/13; H04R 2203/12; H04R 2205/024; H04R 29/001; H04R 1/02; H04R 1/20; H04R 1/24; H04R 1/26; H04R 1/345; H04R 2201/34

See application file for complete search history.

(56) References Cited

U.S. PATENT DOCUMENTS 4,296,278 A 10/1981 Cullison et al.
4,306,113 A 12/1981 Morton
(Continued)

FOREIGN PATENT DOCUMENTS

EP 0492919 A2 7/1992
EP 1133896 B1 8/2002
(Continued)

OTHER PUBLICATIONS

Japanese Patent Office, Office Action mailed on Feb. 16, 2016, issued in connection with JP Application No. 2015-530043, 7 pages.
(Continued)

*Primary Examiner* — Matthew Eason

(57) ABSTRACT

Apparatus and methods are disclosed for acoustic optimization. An example playback device includes a first transducer to at least one of output sound waves and receive sound waves, a second transducer to at least one of output sound waves and receive sound waves, and an acoustic grille positioned in relation to the first transducer, where the acoustic grille is to reflect sound waves received at a first angle of incidence.

20 Claims, 12 Drawing Sheets

(56) References Cited

U.S. PATENT DOCUMENTS 4,592,088 A 5/1986 Shimada
4,995,778 A 2/1991 Brussel
5,025,472 A * 6/1991 Shimizu ..... G10H 1/0091 381/63
5,031,220 A * 7/1991 Takagi ..... B60R 11/0217 181/155
5,117,463 A * 5/1992 Oyaba ..... H04R 1/345 181/159
5,386,478 A 1/1995 Plunkett
5,673,323 A 9/1997 Schotz et al.
5,910,991 A 6/1999 Farrar
5,923,902 A 7/1999 Inagaki
5,946,343 A 8/1999 Schotz et al.
5,970,161 A 10/1999 Takashima et al.
6,243,322 B1 * 6/2001 Zakarauskas ..... G01S 11/14 367/124
6,256,554 B1 7/2001 DiLorenzo
6,343,132 B1 * 1/2002 Fukuhara ..... H04R 1/26 181/185
6,404,811 B1 6/2002 Cvetko et al.
6,522,886 B1 2/2003 Youngs et al.
6,611,537 B1 8/2003 Edens et al.
6,631,410 B1 10/2003 Kowalski et al.
6,721,428 B1 4/2004 Allred et al.
6,757,517 B2 6/2004 Chang
6,766,025 B1 7/2004 Levy et al.
6,778,869 B2 8/2004 Champion
7,058,186 B2 6/2006 Tanaka
7,072,477 B1 7/2006 Kincaid
7,103,187 B1 9/2006 Neuman
7,130,608 B2 10/2006 Hollstrom et al.
7,130,616 B2 10/2006 Janik
7,143,939 B2 12/2006 Henzerling
7,236,773 B2 6/2007 Thomas
7,324,654 B2 * 1/2008 Opie ..... H04R 1/26 381/345
7,433,483 B2 * 10/2008 Fincham ..... H04S 1/002 381/337
7,483,538 B2 1/2009 McCarty et al.
7,489,784 B2 2/2009 Yoshino
7,490,044 B2 2/2009 Kulkarni
7,492,909 B2 2/2009 Carter, Jr.
7,519,188 B2 4/2009 Berardi et al.
7,529,377 B2 5/2009 Nackvi et al.
7,571,014 B1 8/2009 Lambourne et al.
7,630,500 B1 12/2009 Beckman et al.
7,630,501 B2 12/2009 Blank et al.
7,643,894 B2 1/2010 Braithwaite et al.
7,657,910 B1 2/2010 McAulay et al.
7,676,044 B2 3/2010 Sasaki et al.
7,853,341 B2 12/2010 McCarty et al.
7,866,438 B2 * 1/2011 Stewart, Jr. ..... H04R 1/2865 181/148
7,912,238 B2 * 3/2011 LaMarra ..... H04R 1/323 381/150
7,949,140 B2 5/2011 Kino
7,961,893 B2 6/2011 Kino
8,014,423 B2 9/2011 Thaler et al.
8,014,545 B2 * 9/2011 Grant ..... H04R 1/025 181/150
8,031,896 B2 10/2011 Chick et al.
8,031,897 B2 10/2011 Bastyr et al.
8,045,952 B2 10/2011 Qureshey et al.
8,063,698 B2 11/2011 Howard
8,103,009 B2 1/2012 McCarty et al.
8,139,774 B2 3/2012 Berardi et al.
8,160,281 B2 4/2012 Kim et al.
8,175,292 B2 5/2012 Aylward et al.
8,189,841 B2 5/2012 Litovsky et al.
8,218,397 B2 * 7/2012 Chan ..... G01S 11/14 367/124
8,229,125 B2 7/2012 Short
8,233,632 B1 7/2012 Macdonald et al.
8,234,395 B2 7/2012 Millington
8,238,578 B2 8/2012 Aylward
8,243,961 B1 8/2012 Morrill
8,265,310 B2 9/2012 Berardi et al.
8,270,620 B2 9/2012 Christensen
8,290,185 B2 10/2012 Kim
8,306,235 B2 11/2012 Mahowald
8,325,935 B2 12/2012 Rutschman
8,331,585 B2 12/2012 Hagen et al.
8,345,892 B2 1/2013 Jung et al.
8,391,501 B2 3/2013 Khawand et al.
8,401,202 B2 3/2013 Brooking
8,452,020 B2 5/2013 Gregg et al.
8,577,045 B2 11/2013 Gibbs
8,577,048 B2 11/2013 Chaikin et al.
8,600,075 B2 12/2013 Lim
8,620,006 B2 12/2013 Berardi et al.
8,638,968 B2 1/2014 Gladwin
8,675,899 B2 3/2014 Jung
8,811,648 B2 8/2014 Pance et al.
8,855,319 B2 10/2014 Liu et al.
8,879,761 B2 11/2014 Johnson et al.
8,914,559 B2 12/2014 Kalayjian et al.
8,934,647 B2 1/2015 Joyce et al.
8,934,655 B2 1/2015 Breen et al.
8,934,657 B2 1/2015 Wilk
8,965,033 B2 2/2015 Wiggins
8,965,546 B2 2/2015 Visser et al.
8,977,974 B2 3/2015 Kraut
8,984,442 B2 3/2015 Pirnack et al.
9,020,153 B2 4/2015 Britt, Jr.
9,264,839 B2 * 2/2016 Oishi ..... G06F 3/165
2001/0042107 A1 11/2001 Palm
2002/0022453 A1 2/2002 Balog et al.
2002/0026442 A1 2/2002 Lipscomb et al.
2002/0086656 A1 * 7/2002 Mattisson ..... H04M 1/6016 455/355
2002/0124097 A1 9/2002 Isely et al.
2003/0053644 A1 3/2003 Vandersteen
2003/0157951 A1 8/2003 Hasty, Jr.
2004/0005074 A1 1/2004 George
2004/0024478 A1 2/2004 Hans et al.
2004/0131217 A1 * 7/2004 Opie ..... H04R 1/26 381/336
2004/0252400 A1 * 12/2004 Blank ..... G06F 17/30017 360/70
2005/0254662 A1 * 11/2005 Blank ..... H04S 7/301 381/58
2006/0109997 A1 5/2006 Kano et al.
2007/0142944 A1 6/2007 Goldberg et al.
2009/0046875 A1 * 2/2009 Masuda ..... H04R 1/30 381/152
2010/0142735 A1 6/2010 Yoon et al.
2011/0170710 A1 7/2011 Son
2012/0051558 A1 3/2012 Kim et al.
2012/0121092 A1 5/2012 Starobin
2012/0127831 A1 5/2012 Gicklhorn et al.
2012/0263325 A1 10/2012 Freeman et al.
2012/0327115 A1 * 12/2012 Chhetri ..... H04R 3/005 345/633
2013/0010970 A1 1/2013 Hegarty et al.
2013/0028443 A1 1/2013 Pance et al.
2013/0089218 A1 * 4/2013 Kishinami ..... H04R 1/403 381/92
2013/0202149 A1 8/2013 Yoon
2013/0259254 A1 10/2013 Xiang et al.
2013/0315429 A1 11/2013 Parker et al.
2014/0016784 A1 1/2014 Sen et al.
2014/0016786 A1 1/2014 Sen
2014/0016802 A1 1/2014 Sen
2014/0023196 A1 1/2014 Xiang et al.
2014/0112481 A1 4/2014 Li et al.
2014/0219456 A1 8/2014 Morrell et al.
2014/0226823 A1 8/2014 Sen et al.
2014/0294200 A1 10/2014 Baumgarte et al.
2014/0355768 A1 12/2014 Sen et al.
2014/0355794 A1 12/2014 Morrell et al.
2015/0063610 A1 3/2015 Mossner
2015/0146886 A1 5/2015 Baumgarte
2015/0201274 A1 7/2015 Ellner et al.

(56) References Cited

U.S. PATENT DOCUMENTS

| | | | | |
|---|---|---|---|---|
| 2015/0208188 | A1* | 7/2015 | Carlsson | H04R 29/001 381/79 |
| 2015/0281866 | A1 | 10/2015 | Williams et al. | |
| 2015/0382128 | A1* | 12/2015 | Ridihalgh | H04S 7/301 381/57 |

FOREIGN PATENT DOCUMENTS

| | | | |
|---|---|---|---|
| EP | 1825713 | B1 | 10/2012 |
| EP | 2860992 | A1 | 4/2015 |
| FR | 2969894 | A1 | 6/2012 |
| JP | S52164522 | U | 12/1977 |
| JP | S5650695 | | 5/1981 |
| JP | 04167697 | | 6/1992 |
| JP | H0543692 | | 6/1993 |
| JP | 0757038 | | 6/1995 |
| JP | 08317488 | | 11/1996 |
| JP | H0937372 | | 2/1997 |
| JP | H10108292 | | 4/1998 |
| JP | 2003084782 | | 3/2003 |
| JP | 2006115180 | | 4/2006 |
| KR | 20100126014 | | 12/2010 |
| WO | 0153994 | | 7/2001 |
| WO | 2015024881 | A1 | 2/2015 |

OTHER PUBLICATIONS

Meyer Sound Laboratories, Inc., "Constellation Acoustic System: a revolutionary breakthrough in acoustical design," retrieved from <http://www.meyersound.com/pdf/brochures/constellation_brochure_c.pdf>, 2012, 32 pages.

Meyer Sound Laboratories, Inc., "Constellation Microphones," retrieved from <http://www.meyersound.com/sites/default/files/constellation_microphones.pdf>, 2013, 2 pages.

Ross, Alex, "Wizards of Sound: Retouching acoustics, from the restaurant to the concert hall," The New Yorker, Feb. 23, 2015, retrieved on Jun. 1, 2015, 9 pages.

European Patent Office, "Extended European Search Report", issued in connection with corresponding European Patent Application No. 13833100.4, on Jul. 21, 2015, 7 pages.

Bluetooth, "Specification of the Bluetooth System: The Ad Hoc SCATTERNET for Affordable and Highly Functional Wireless Connectivity," Core, Version 1.0 A, Jul. 26, 1999 (1068 pages). (Document uploaded in 7 different files: NPL1_part1 pp. 1 to 150, NPL1_part2 pp. 151 to 300, NPL1_part3 pp. 301 to 450, NPL1_part4 pp. 451 to 600,NPL1_part5 pp. 601 to 750, NPL1_part6 pp. 751 to 900 and NPL1_part7 pp. 901 to 1068).

Bluetooth, "Specification of the Bluetooth System: Wireless Connections Made Easy," Core, Version 1.0 B, Dec. 1, 1999 (1082 pages). (Document uploaded in 9 different files: NPL2_part1 pp. 1 to 152, NPL2_part2 pp. 153 to 303, NPL2_part3 pp. 304 to 453, NPL2_part4 pp. 454 to 603,NPL2_part5 pp. 604 to 704, NPL2_part6 pp. 705 to 753, NPL2_part7 pp. 754 to 854, NPL2_part8 pp. 855-1005 and NPL2_part9 pp. 1006-1081).

Dell Computer Corporation, "Dell Digital Audio Receiver: Reference Guide," Jun. 2000 (70 pages).

Dell Computer Corporation, "Dell Digital Audio Receiver: Start Here," Jun. 2000 (2 pages).

Jo et al., "Synchronized One-to-Many Media Streaming with Adaptive Playout Control," Proceedings of SPIE, vol. 4861, Dec. 2002 (11 pages).

Jones, Stephen, "Dell Digital Audio Receiver: Digital Upgrade for your Analog Stereo," Reviews Online, Jun. 24, 2000, retrieved from <http://www.reviewsonline.com/articles/961906864.htm>, retrieved on Jun. 18, 2014 (2 pages).

Louderback, Jim, "Affordable Audio Receiver Furnishes Homes With MP3," TechTV Vault, Jun. 28, 2000, retrieved from <http://www.g4tv.com/articles/17923/affordable-audio-receiver-furnishes-homes-with-mp3/>, retrieved on Jul. 10, 2014 (2 pages).

Palm, Inc., "Handbook for the Palm VII Handheld," May 19, 2000 (311 pages).(Document uploaded in 2 different files: NPL8_part1 pp. 1 to 150 and NPL8_part2 pp. 151 to 300).

Higgins et al., Microsoft Corporation, "Presentations at WinHEC 2000", May 2000 (138 pages).

International Searching Authority, "International Search Report and Written Opinion," issued in connection with International Patent Application No. PCT/US2013/057305, mailed Dec. 17, 2013 (10 pages).

International Searching Authority, "International Preliminary Report on Patentability," issued in connection with International Patent Application No. PCT/US2013/057305, mailed Mar. 12, 2015 (7 pages).

Voyetra Turtle Beach, Inc., "AudioTron Quick Start Guide, Version 1.0," Mar. 2001 (24 pages).

Voyetra Turtle Beach, Inc., "AudioTron Reference Manual, Version 3.0," May 2002 (70 pages).

Voyetra Turtle Beach, Inc., "AudioTron Setup Guide, Version 3.0," May 2002 (38 pages).

Microsoft Corporation, "Universal Plug and Play Device Architecture, Version 1.0," Jun. 8, 2000, retrieved from <ftp://vtm.upnp.org/upnp/specs/arch/UPnPDA10_20000613.htm>, retrieved on Apr. 6, 2010 (54 pages).

United States Patent and Trademark Office, "Advisory Action," issued in connection with U.S. Appl. No. 13/601,519, mailed Nov. 14, 2014 (2 pages).

United States Patent and Trademark Office, "Final Office Action," issued in connection with U.S. Appl. No. 13/601,519, mailed Sep. 4, 2014 (7 pages).

United States Patent and Trademark Office, "Non-Final Office Action," issued in connection with U.S. Appl. No. 13/601,519, mailed May 21, 2014 (7 pages).

United States Patent and Trademark Office, "Notice of Allowance," issued in connection with U.S. Appl. No. 13/601,519, mailed Dec. 10, 2014 (12 pages).

United States Patent and Trademark Office, "Supplemental Notice of Allowability," issued in connection with U.S. Appl. No. 13/601,519, mailed Jan. 21, 2015 (2 pages).

* cited by examiner

PLAYBACK BASED ON RECEIVED SOUND WAVES

FIELD OF THE DISCLOSURE

The disclosure is related to consumer goods and, more particularly, to systems, products, features, services, and other items directed to media playback or some aspect thereof.

BACKGROUND

Technological advancements have increased the accessibility of music content, as well as other types of media, such as television content, movies, and interactive content. For example, a user can access audio, video, or both audio and video content over the Internet through an online store, an Internet radio station, a music service, a movie service, and so on, in addition to the more traditional avenues of accessing audio and video content. Demand for audio, video, and both audio and video content inside and outside of the home continues to increase.

BRIEF DESCRIPTION OF THE DRAWINGS

Features, aspects, and advantages of the presently disclosed technology are better understood with regard to the following description, appended claims, and accompanying drawings where:

Figure 1:
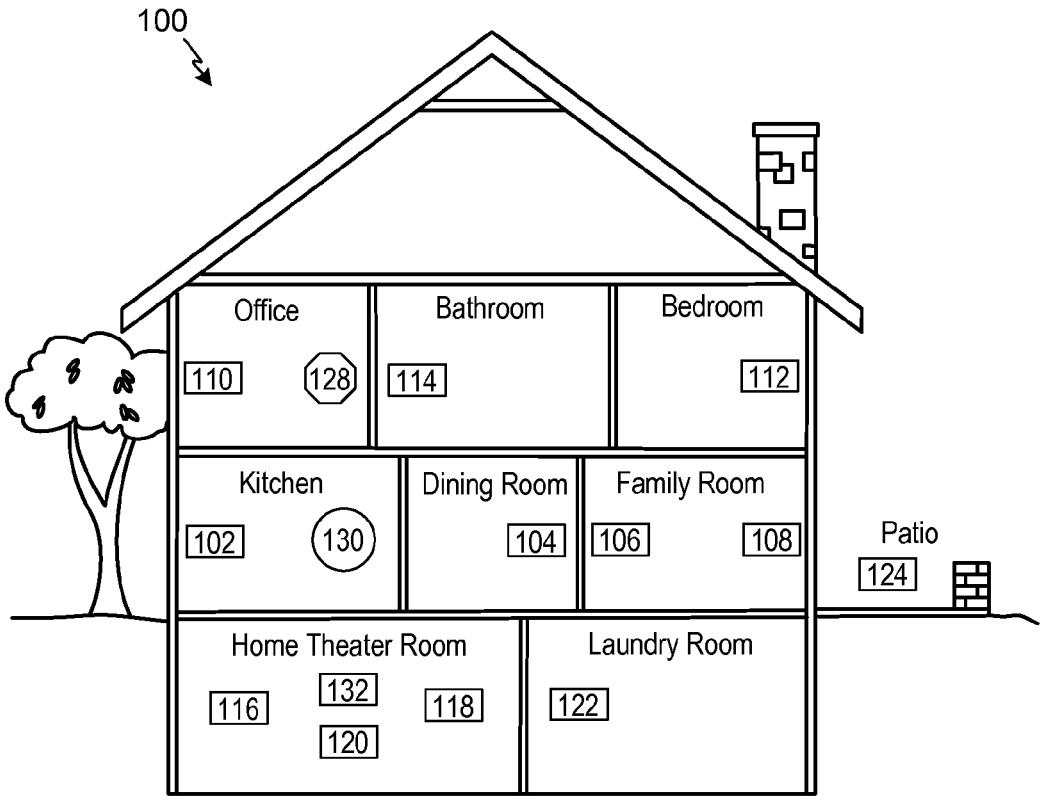
FIG. 1 shows an example configuration in which certain embodiments may be practiced.

In addition, the drawings are for the purpose of illustrating example embodiments, but it is understood that the inventions are not limited to the arrangements and instrumentality shown in the drawings.

DETAILED DESCRIPTION

I. Overview

Certain embodiments disclosed herein enable acoustic optimization in an audio device with multiple acoustic transducers via an acoustic grille. Acoustic transducers (also referred to as "drivers") generally output sound waves, receive sound waves, or output and receive sound waves. For example, an audio playback device may include a tweeter, a mid-range driver, a low-range driver and/or any other combination of a tweeter, a mid-range driver and a low-range driver. However, the structure of the playback device (e.g., the enclosure, the baffle, the proximity of an adjacent transducer, and so on) will often cause interference patterns between the sound waves of adjacent transducers. These interference patterns are often undesirable and, for example, can result in audio distortion (e.g., Doppler or intermodulation distortion (IMD)) or phase shifting (e.g., as seen in the frequency response as comb filtering).

In another example, an audio playback device may include at least two (e.g., mid-range) drivers, one to play sound waves and one to receive sound waves. The adjacent drivers may interfere such that the sound waves from the driver playing the sound waves may be received from the driver receiving the sound waves. This interference often manifests itself as feedback or noise.

In yet another example, an audio receiving device may include multiple acoustic transducers to receive sound waves. For example, a two-dimensional microphone array may include four mid-range drivers to receive audio in the four corners of a large presentation board mounted on a wall or flat surface. In addition to receiving sound waves, the microphone array may be used to detect the general location of an audio source (e.g., detect the location of a person giving a presentation) relative to the presentation board. However, the sound waves of an audio source may arrive at varying angles at each microphone giving similar, or substantially similar, level measurements (e.g., sound pressure level (SPL), electrical signal output, etc.)

The examples disclosed herein enable optimizing acoustical output via an acoustic grille. The examples disclosed herein provide an acoustic grille composed of a variable-acoustic-opacity material. The properties of the material allow higher angles of incidence wave components to pass through the acoustic grille. Additionally, the properties of the material block (or reflect) lower angles of incidence wave components from passing through the acoustic grille. Additional embodiments are described herein.

II. An Example Operating Environment

Referring now to the drawings, in which like numerals can refer to like parts throughout the figures, FIG. 1 shows an example system configuration 100 in which one or more embodiments disclosed herein can be practiced or implemented.

By way of illustration, the system configuration 100 represents a home with multiple zones, though the home could have been configured with only one zone. Each zone, for example, may represent a different room or space, such as an office, bathroom, bedroom, kitchen, dining room, family room, home theater room, utility or laundry room, and patio. A single zone might also include multiple rooms or spaces if so configured. One or more of zone players 102-124 are shown in each respective zone. A zone player 102-124, also referred to as a playback device, multimedia unit, speaker, player, and so on, provides audio, video, and/or audiovisual output. A controller 130 (e.g., shown in the kitchen for purposes of illustration) provides control to the system configuration 100. Controller 130 may be fixed to a zone, or alternatively, mobile such that it can be moved about the zones. The system configuration 100 may also include more than one controller 130. The system configuration 100 illustrates an example whole house audio system, though it is understood that the technology described herein is not limited to its particular place of application or to an expansive system like a whole house audio system 100 of FIG. 1.

a. Example Zone Players

Figure 2A:
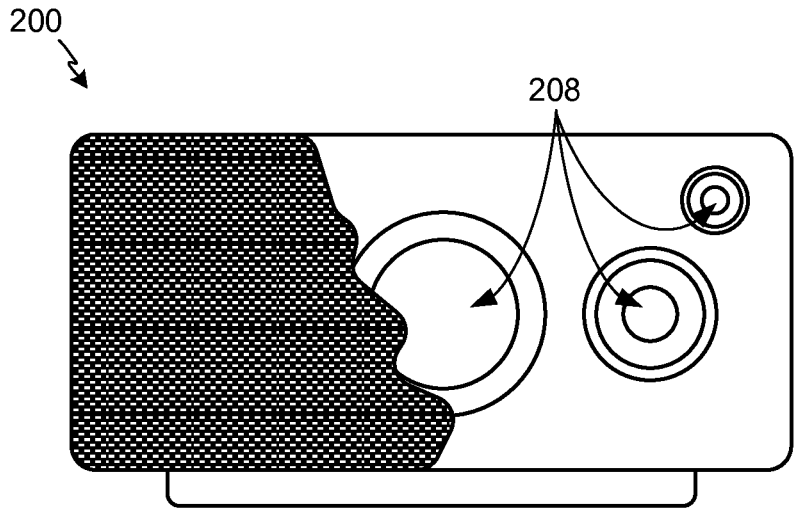
FIG. 2A shows an illustration of an example zone player having a built-in amplifier and transducers.
Figure 2B:
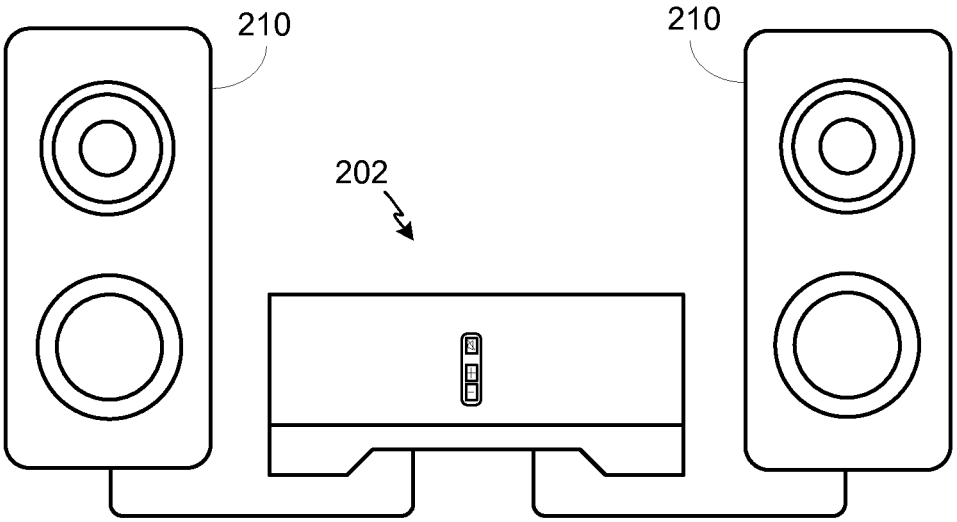
FIG. 2B shows an illustration of an example zone player having a built-in amplifier and connected to external speakers.
Figure 2C:
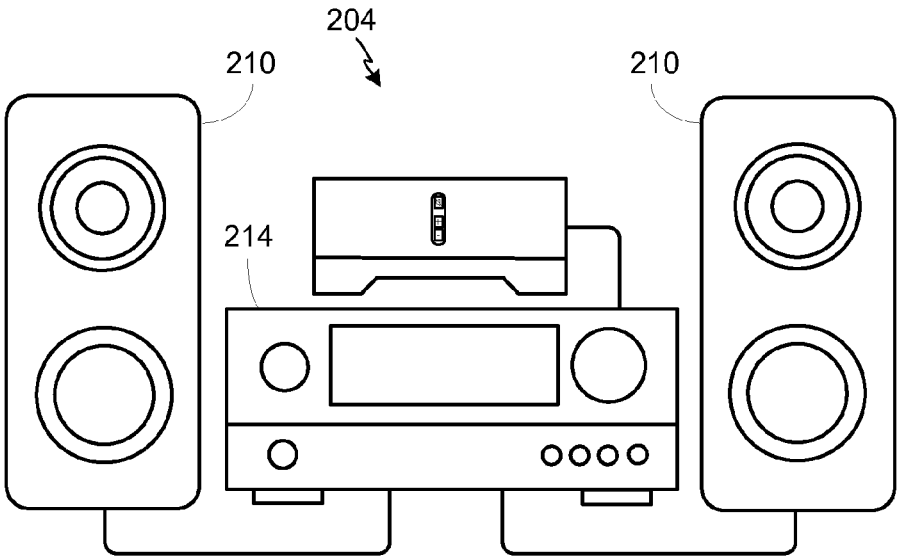
FIG. 2C shows an illustration of an example zone player connected to an A/V receiver and speakers.

FIGS. 2A, 2B, and 2C show example types of zone players. Zone players 200, 202, and 204 of FIGS. 2A, 2B, and 2C, respectively, can correspond to any of the zone players 102-124 of FIG. 1, for example. In some embodiments, audio is reproduced using only a single zone player, such as by a full-range player. In some embodiments, audio is reproduced using two or more zone players, such as by using a combination of full-range players or a combination of full-range and specialized players. In some embodiments, zone players 200-204 may also be referred to as a "smart speaker," because they contain processing capabilities beyond the reproduction of audio, more of which is described below.

FIG. 2A illustrates zone player 200 that includes sound producing equipment 208 capable of reproducing full-range sound. The sound may come from an audio signal that is received and processed by zone player 200 over a wired or wireless data network. Sound producing equipment 208 includes one or more built-in amplifiers and one or more acoustic transducers (e.g., speakers). A built-in amplifier is described in more detail below with respect to FIG. 4. A speaker or acoustic transducer can include, for example, any of a tweeter, a mid-range driver, a low-range driver, and a subwoofer. In some embodiments, zone player 200 can be statically or dynamically configured to play stereophonic audio, monaural audio, or both. In some embodiments, zone player 200 is configured to reproduce a subset of full-range sound, such as when zone player 200 is grouped with other zone players to play stereophonic audio, monaural audio, and/or surround audio or when the audio content received by zone player 200 is less than full-range.

FIG. 2B illustrates zone player 202 that includes a built-in amplifier to power a set of detached speakers 210. A detached speaker can include, for example, any type of loudspeaker. Zone player 202 may be configured to power one, two, or more separate loudspeakers. Zone player 202 may be configured to communicate an audio signal (e.g., right and left channel audio or more channels depending on its configuration) to the detached speakers 210 via a wired path.

FIG. 2C illustrates zone player 204 that does not include a built-in amplifier, but is configured to communicate an audio signal, received over a data network, to an audio (or "audio/video") receiver 214 with built-in amplification.

Referring back to FIG. 1, in some embodiments, one, some, or all of the zone players 102 to 124 can retrieve audio directly from a source. For example, a zone player may contain a playlist or queue of audio items to be played (also referred to herein as a "playback queue"). Each item in the queue may comprise a uniform resource identifier (URI) or some other identifier. The URI or identifier can point the zone player to the audio source. The source might be found on the Internet (e.g., the cloud), locally from another device over data network 128 (described further below), from the controller 130, stored on the zone player itself, or from an audio source communicating directly to the zone player. In some embodiments, the zone player can reproduce the audio itself, send it to another zone player for reproduction, or both where the audio is played by the zone player and one or more additional zone players in synchrony. In some embodiments, the zone player can play a first audio content (or not play at all), while sending a second, different audio content to another zone player(s) for reproduction.

By way of illustration, SONOS, Inc. of Santa Barbara, Calif. presently offers for sale zone players referred to as a "PLAY:5," "PLAY:3," "CONNECT:AMP," "CONNECT," and "SUB." Any other past, present, and/or future zone players can additionally or alternatively be used to implement the zone players of example embodiments disclosed herein. Additionally, it is understood that a zone player is not limited to the particular examples illustrated in FIGS. 2A, 2B, and 2C or to the SONOS product offerings. For example, a zone player may include a wired or wireless headphone. In yet another example, a zone player might include a sound bar for television. In yet another example, a zone player can include or interact with a docking station for an Apple IPOD™ or similar device.

b. Example Controllers

Figure 3:
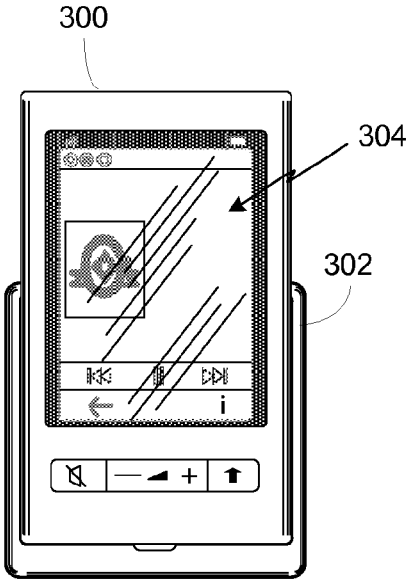
FIG. 3 shows an illustration of an example controller.

FIG. 3 illustrates an example wireless controller 300 in docking station 302. By way of illustration, controller 300 can correspond to controlling device 130 of FIG. 1. Docking station 302, if provided, may be used to charge a battery of controller 300. In some embodiments, controller 300 is provided with a touch screen 304 that allows a user to interact through touch with the controller 300, for example, to retrieve and navigate a playlist of audio items, control operations of one or more zone players, and provide overall control of the system configuration 100. In certain embodiments, any number of controllers can be used to control the system configuration 100. In some embodiments, there can be a limit set on the number of controllers that can control the system configuration 100. The controllers might be wireless like wireless controller 300 or wired to data network 128.

In some embodiments, if more than one controller is used in system 100, then each controller may be coordinated to display common content, and may all be dynamically updated to indicate changes made from a single controller. Coordination can occur, for instance, by a controller periodically requesting a state variable directly or indirectly from one or more zone players; the state variable may provide information about system 100, such as current zone group configuration, what is playing in one or more zones, volume levels, and other items of interest. The state variable may be passed around on data network 128 between zone players (and controllers, if so desired) as needed or as often as programmed.

In addition, an application running on any network-enabled portable device, such as an IPHONE™, IPAD™, ANDROID™ powered phone, or any other smart phone or network-enabled device can be used as controller 130. An application running on a laptop or desktop personal computer (PC) or MAC® can also be used as controller 130. Such controllers may connect to system 100 through an interface with data network 128, a zone player, a wireless router, or using some other configured connection path.

Example controllers offered by SONOS, Inc. of Santa Barbara, Calif. include a "Controller 200," "SONOS® CONTROL," "SONOS® Controller for iPhone," "SONOS® Controller for IPAD™," "SONOS® Controller for ANDROID™, "SONOS® Controller for MAC or PC."

c. Example Data Connection

Zone players 102 to 124 of FIG. 1 are coupled directly or indirectly to a data network, such as data network 128. Controller 130 may also be coupled directly or indirectly to data network 128 or individual zone players. Data network 128 is represented by an octagon in the figure to stand out from other representative components. While data network 128 is shown in a single location, it is understood that such a network is distributed in and around system 100. Particularly, data network 128 can be a wired network, a wireless network, or a combination of both wired and wireless networks. In some embodiments, one or more of the zone players 102-124 are wirelessly coupled to data network 128 based on a proprietary mesh network. In some embodiments, one or more of the zone players 102-124 are wirelessly coupled to data network 128 using a non-mesh topology. In some embodiments, one or more of the zone players 102-124 are coupled via a wire to data network 128 using Ethernet or similar technology. In addition to the one or more zone players 102-124 connecting to data network 128, data network 128 can further allow access to a wide area network, such as the Internet.

In some embodiments, connecting any of the zone players 102-124, or some other connecting device, to a broadband router, can create data network 128. Other zone players 102-124 can then be added wired or wirelessly to the data network 128. For example, a zone player (e.g., any of zone players 102-124) can be added to the system configuration 100 by simply pressing a button on the zone player itself (or perform some other action), which enables a connection to be made to data network 128. The broadband router can be connected to an Internet Service Provider (ISP), for example. The broadband router can be used to form another data network within the system configuration 100, which can be used in other applications (e.g., web surfing). Data network 128 can also be used in other applications, if so programmed. An example, second network may implement SONOSNET™ protocol, developed by SONOS, Inc. of Santa Barbara. SONOSNET™ represents a secure, AES-encrypted, peer-to-peer wireless mesh network. Alternatively, in certain embodiments, the data network 128 is the same network, such as a traditional wired or wireless network, used for other applications in the household.

d. Example Zone Configurations

A particular zone can contain one or more zone players. For example, the family room of FIG. 1 contains two zone players 106 and 108, while the kitchen is shown with one zone player 102. In another example, the home theater room contains additional zone players to play audio from a 5.1 channel or greater audio source (e.g., a movie encoded with 5.1 or greater audio channels). In some embodiments, one can position a zone player in a room or space and assign the zone player to a new or existing zone via controller 130. As such, zones may be created, combined with another zone, removed, and given a specific name (e.g., "Kitchen"), if so desired and programmed to do so with controller 130. Moreover, in some embodiments, zone configurations may be dynamically changed even after being configured using controller 130 or some other mechanism.

In some embodiments, if a zone contains two or more zone players, such as the two zone players 106 and 108 in the family room, then the two zone players 106 and 108 can be configured to play the same audio source in synchrony, or the two zone players 106 and 108 can be paired to play two separate sounds in left and right channels, for example. In other words, the stereo effects of a sound can be reproduced or enhanced through the two zone players 106 and 108, one for the left sound and the other for the right sound. In certain embodiments, paired zone players (also referred to as "bonded zone players") can play audio in synchrony with other zone players in the same or different zones.

In some embodiments, two or more zone players can be sonically consolidated to form a single, consolidated zone player. A consolidated zone player (though made up of multiple, separate devices) can be configured to process and reproduce sound differently than an unconsolidated zone player or zone players that are paired, because a consolidated zone player will have additional speaker drivers from which sound can be passed. The consolidated zone player can further be paired with a single zone player or yet another consolidated zone player. Each playback device of a consolidated playback device can be set in a consolidated mode, for example.

According to some embodiments, one can continue to do any of: group, consolidate, and pair zone players, for example, until a desired configuration is complete. The actions of grouping, consolidation, and pairing are preferably performed through a control interface, such as using controller 130, and not by physically connecting and reconnecting speaker wire, for example, to individual, discrete speakers to create different configurations. As such, certain embodiments described herein provide a more flexible and dynamic platform through which sound reproduction can be offered to the end-user.

e. Example Audio Sources

In some embodiments, each zone can play from the same audio source as another zone or each zone can play from a different audio source. For example, someone can be grilling on the patio and listening to jazz music via zone player 124, while someone is preparing food in the kitchen and listening to classical music via zone player 102. Further, someone can be in the office listening to the same jazz music via zone player 110 that is playing on the patio via zone player 124. In some embodiments, the jazz music played via zone players 110 and 124 is played in synchrony. Synchronizing playback amongst zones allows for someone to pass through zones while seamlessly (or substantially seamlessly) listening to the audio. Further, zones can be put into a "party mode" such that all associated zones will play audio in synchrony.

Sources of audio content to be played by zone players 102-124 are numerous. In some embodiments, music on a zone player itself may be accessed and played. In some embodiments, music from a personal library stored on a computer or networked-attached storage (NAS) may be accessed via the data network 128 and played. In some embodiments, Internet radio stations, shows, and podcasts can be accessed via the data network 128. Music or cloud services that let a user stream and/or download music and audio content can be accessed via the data network 128. Further, music can be obtained from traditional sources, such as a turntable or CD player, via a line-in connection to a zone player, for example. Audio content can also be accessed using a different protocol, such as AIRPLAY™, which is a wireless technology by Apple, Inc., for example. Audio content received from one or more sources can be shared amongst the zone players 102 to 124 via data network 128 and/or controller 130. The above-disclosed sources of audio content are referred to herein as network-based audio information sources. However, network-based audio information sources are not limited thereto.

In some embodiments, the example home theater zone players 116, 118, 120 are coupled to an audio information source such as a television 132. In some examples, the television 132 is used as a source of audio for the home theater zone players 116, 118, 120, while in other examples audio information from the television 132 can be shared with any of the zone players 102-124 in the audio system 100.

III. Example Zone Players

Figure 4:
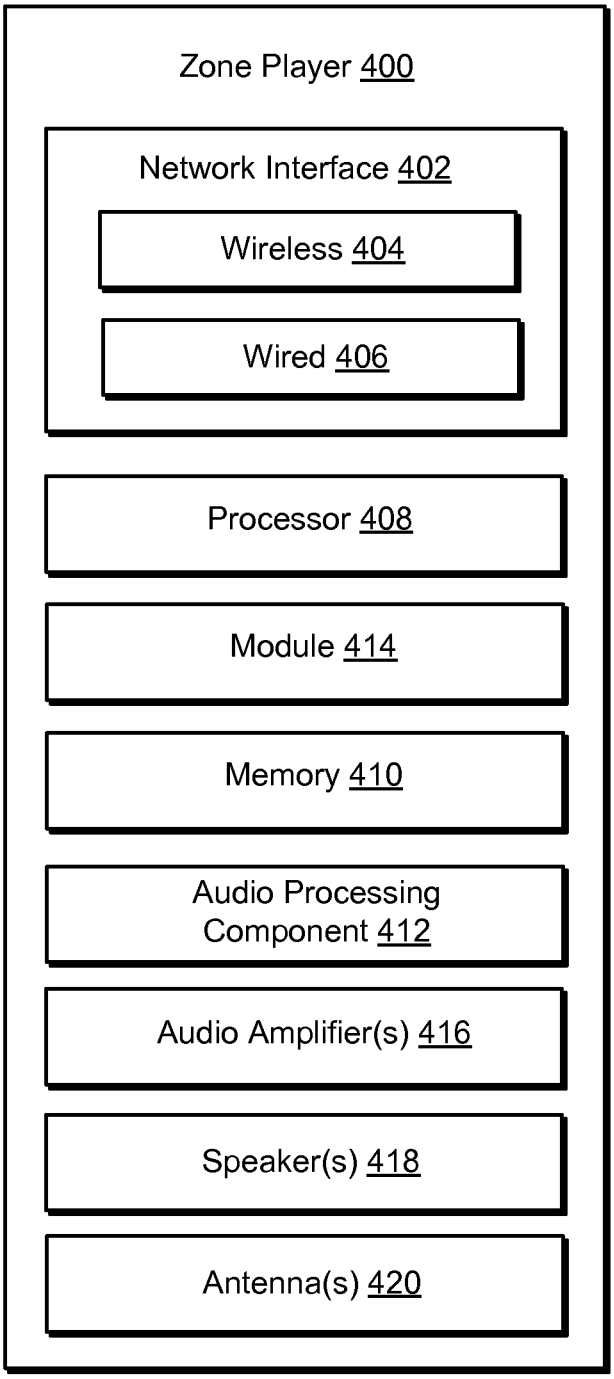
FIG. 4 shows an internal functional block diagram of an example zone player.

Referring now to FIG. 4, there is shown an example block diagram of a zone player 400 in accordance with an embodiment. Zone player 400 includes a network interface 402, a processor 408, a memory 410, an audio processing component 412, one or more modules 414, an audio amplifier 416, and a speaker unit 418 coupled to the audio amplifier 416. FIG. 2A shows an example illustration of such a zone player. Other types of zone players may not include the speaker unit 418 (e.g., such as shown in FIG. 2B) or the audio amplifier 416 (e.g., such as shown in FIG. 2C). Further, it is contemplated that the zone player 400 can be integrated into another component. For example, the zone player 400 could be constructed as part of a television, lighting, or some other device for indoor or outdoor use.

In some embodiments, network interface 402 facilitates a data flow between zone player 400 and other devices on a data network 128. In some embodiments, in addition to getting audio from another zone player or device on data network 128, zone player 400 may access audio directly from the audio source, such as over a wide area network or on the local network. In some embodiments, the network interface 402 can further handle the address part of each packet so that it gets to the right destination or intercepts packets destined for the zone player 400. Accordingly, in certain embodiments, each of the packets includes an Internet Protocol (IP)-based source address as well as an IP-based destination address.

In some embodiments, network interface 402 can include one or both of a wireless interface 404 and a wired interface 406. The wireless interface 404, also referred to as a radio frequency (RF) interface, provides network interface functions for the zone player 400 to wirelessly communicate with other devices (e.g., other zone player(s), speaker(s), receiver(s), component(s) associated with the data network 128, and so on) in accordance with a communication protocol (e.g., any wireless standard including IEEE 802.11a, 802.11b, 802.11g, 802.11n, or 802.15). Wireless interface 404 may include one or more radios. To receive wireless signals and to provide the wireless signals to the wireless interface 404 and to transmit wireless signals, the zone player 400 includes one or more antennas 420. The wired interface 406 provides network interface functions for the zone player 400 to communicate over a wire with other devices in accordance with a communication protocol (e.g., IEEE 802.3). In some embodiments, a zone player 400 includes multiple wireless interfaces 404. In some embodiments, a zone player includes multiple wired interfaces 406. In some embodiments, a zone player includes both of the interfaces 404 and 406. In some embodiments, a zone player 400 includes only the wireless interface 404 or the wired interface 406.

In some embodiments, the processor 408 is a clock-driven electronic device that is configured to process input data according to instructions stored in memory 410. The memory 410 is data storage that can be loaded with one or more software module(s) 414, which can be executed by the processor 408 to achieve certain tasks. In the illustrated embodiment, the memory 410 is a tangible machine-readable medium storing instructions that can be executed by the processor 408. In some embodiments, a task might be for the zone player 400 to retrieve audio data from another zone player or a device on a network (e.g., using a uniform resource locator (URL) or some other identifier). In some embodiments, a task may be for the zone player 400 to send audio data to another zone player or device on a network. In some embodiments, a task may be for the zone player 400 to synchronize playback of audio with one or more additional zone players. In some embodiments, a task may be to pair the zone player 400 with one or more zone players to create a multi-channel audio environment. Additional or alternative tasks can be achieved via the one or more software module(s) 414 and the processor 408.

The audio processing component 412 can include one or more digital-to-analog converters (DAC), an audio preprocessing component, an audio enhancement component or a digital signal processor, and so on. In some embodiments, the audio processing component 412 may be part of processor 408. In some embodiments, the audio that is retrieved via the network interface 402 is processed and/or intentionally altered by the audio processing component 412. Further, the audio processing component 412 can produce analog audio signals. The processed analog audio signals are then provided to the audio amplifier 416 for playback through speakers 418. In addition, the audio processing component 412 can include circuitry to process analog or digital signals as inputs to play from zone player 400, send to another zone player on a network, or both play and send to another zone player on the network. An example input includes a line-in connection (e.g., an auto-detecting 3.5 mm audio line-in connection).

The audio amplifier 416 is a device(s) that amplifies audio signals to a level for driving one or more speakers 418. The one or more speakers 418 can include an individual transducer (e.g., a "driver") or a complete speaker system that includes an enclosure including one or more drivers. A particular driver can be a subwoofer (e.g., for low frequencies), a mid-range driver (e.g., for middle frequencies), and a tweeter (e.g., for high frequencies), for example. An enclosure can be sealed or ported, for example. Each transducer may be driven by its own individual amplifier.

A commercial example, presently known as the PLAY:5™, is a zone player with a built-in amplifier and speakers that is capable of retrieving audio directly from the source, such as on the Internet or on the local network, for example. In particular, the PLAY:5™ is a five-amp, five-driver speaker system that includes two tweeters, two mid-range drivers, and one woofer. When playing audio content via the PLAY:5™, the left audio data of a track is sent out of the left tweeter and left mid-range driver, the right audio data of a track is sent out of the right tweeter and the right mid-range driver, and mono bass is sent out of the subwoofer. Further, both mid-range drivers and both tweeters have the same equalization (or substantially the same equalization). That is, they are both sent the same frequencies, but from different channels of audio. Audio from Internet radio stations, online music and video services, downloaded music, analog audio inputs, television, DVD, and so on, can be played from the PLAY:5™.

IV. Example Controller

Figure 5:
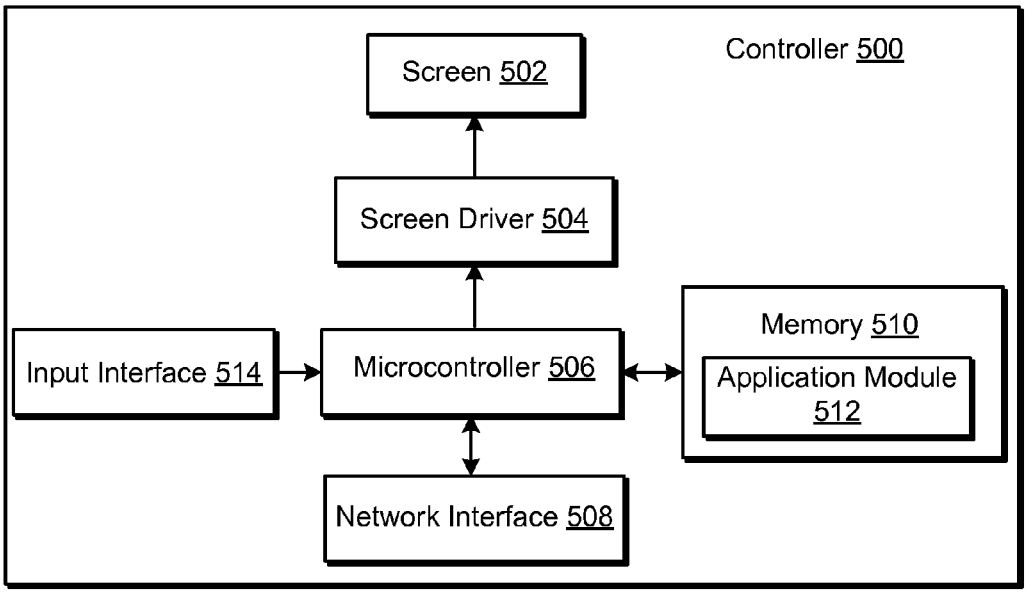
FIG. 5 shows an internal functional block diagram of an example controller.

Referring now to FIG. 5, there is shown an example block diagram for controller 500, which can correspond to the controlling device 130 in FIG. 1. Controller 500 can be used to facilitate the control of multi-media applications, automation and others in a system. In particular, the controller 500 may be configured to facilitate a selection of a plurality of audio sources available on the network and enable control of one or more zone players (e.g., the zone players 102-124 in FIG. 1) through a wireless or wired network interface 508. According to one embodiment, the wireless communications is based on an industry standard (e.g., infrared, radio, wireless standards including IEEE 802.11a, 802.11b 802.11g, 802.11n, or 802.15, and so on). Further, when a particular audio is being accessed via the controller 500 or being played via a zone player, a picture (e.g., album art) or any other data, associated with the audio and/or audio source can be transmitted from a zone player or other electronic device to controller 500 for display.

Controller 500 is provided with a screen 502 and an input interface 514 that allows a user to interact with the controller 500, for example, to navigate a playlist of many multimedia items and to control operations of one or more zone players. The screen 502 on the controller 500 can be an LCD screen, for example. The screen 502 communicates with and is commanded by a screen driver 504 that is controlled by a microcontroller (e.g., a processor) 506. The memory 510 can be loaded with one or more application modules 512 that can be executed by the microcontroller 506 with or without a user input via the input interface 514 to achieve certain tasks. In some embodiments, an application module 512 is configured to facilitate grouping a number of selected zone players into a zone group and synchronizing the zone players for audio playback. In some embodiments, an application module 512 is configured to control the audio sounds (e.g., volume) of the zone players in a zone group. In operation, when the microcontroller 506 executes one or more of the application modules 512, the screen driver 504 generates control signals to drive the screen 502 to display an application specific user interface accordingly.

The controller 500 includes a network interface 508 that facilitates wired or wireless communication with a zone player. In some embodiments, the commands such as volume control and audio playback synchronization are sent via the network interface 508. In some embodiments, a saved zone group configuration is transmitted between a zone player and a controller via the network interface 508. The controller 500 can control one or more zone players, such as 102-124 of FIG. 1. There can be more than one controller for a particular system, and each controller may share common information with another controller, or retrieve the common information from a zone player, if such a zone player stores configuration data (e.g., such as a state variable). Further, a controller can be integrated into a zone player.

It should be noted that other network-enabled devices such as an IPHONE®, IPAD® or any other smart phone or network-enabled device (e.g., a networked computer such as a PC or MAC®) can also be used as a controller to interact or control zone players in a particular environment. In some embodiments, a software application or upgrade can be downloaded onto a network-enabled device to perform the functions described herein.

In certain embodiments, a user can create a zone group (also referred to as a bonded zone) including at least two zone players from the controller 500. The zone players in the zone group can play audio in a synchronized fashion, such that all of the zone players in the zone group playback an identical audio source or a list of identical audio sources in a synchronized manner such that no (or substantially no) audible delays or hiccups are to be heard. Similarly, in some embodiments, when a user increases the audio volume of the group from the controller 500, the signals or data of increasing the audio volume for the group are sent to one of the zone players and causes other zone players in the group to be increased together in volume.

A user via the controller 500 can group zone players into a zone group by activating a "Link Zones" or "Add Zone" soft button, or de-grouping a zone group by activating an "Unlink Zones" or "Drop Zone" button. For example, one mechanism for 'joining' zone players together for audio playback is to link a number of zone players together to form a group. To link a number of zone players together, a user can manually link each zone player or room one after the other. For example, assume that there is a multi-zone system that includes the following zones: Bathroom, Bedroom, Den, Dining Room, Family Room, and Foyer.

In certain embodiments, a user can link any number of the six zone players, for example, by starting with a single zone and then manually linking each zone to that zone.

In certain embodiments, a set of zones can be dynamically linked together using a command to create a zone scene or theme (subsequent to first creating the zone scene). For instance, a "Morning" zone scene command can link the Bedroom, Office, and Kitchen zones together in one action. Without this single command, the user would manually and individually link each zone. The single command may include a mouse click, a double mouse click, a button press, a gesture, or some other programmed action. Other kinds of zone scenes can be programmed.

In certain embodiments, a zone scene can be triggered based on time (e.g., an alarm clock function). For instance, a zone scene can be set to apply at 8:00 am. The system can link appropriate zones automatically, set specific music to play, and then stop the music after a defined duration. Although any particular zone can be triggered to an "On" or "Off" state based on time, for example, a zone scene enables any zone(s) linked to the scene to play a predefined audio (e.g., a favorable song, a predefined playlist) at a specific time and/or for a specific duration. If, for any reason, the scheduled music failed to be played (e.g., an empty playlist, no connection to a share, failed Universal Plug and Play (UPnP), no Internet connection for an Internet Radio station, and so on), a backup buzzer can be programmed to sound. The buzzer can include a sound file that is stored in a zone player, for example.

V. Example Ad-Hoc Network

Figure 6:
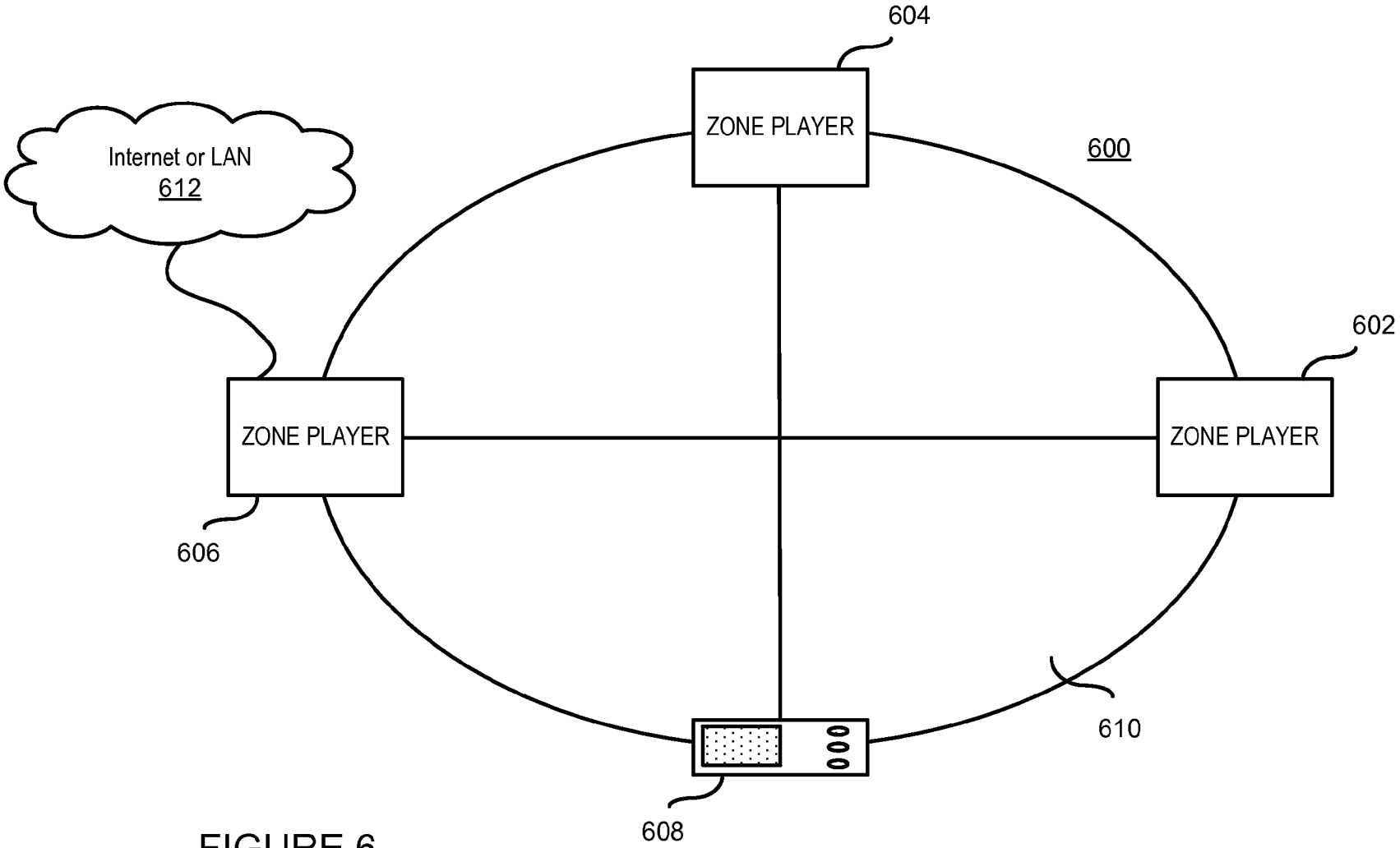
FIG. 6 shows an example ad-hoc playback network.

Certain particular examples are now provided in connection with FIG. 6 to describe, for purposes of illustration, certain systems and methods to provide and facilitate connection to a playback network. FIG. 6 shows that there are three zone players 602, 604 and 606 and a controller 608 that form a network branch that is also referred to as an Ad-Hoc network 610. The network 610 may be wireless, wired, or a combination of wired and wireless. In general, an Ad-Hoc (or "spontaneous") network is a local area network or other small network in which there is generally no one access point for all traffic. With an established Ad-Hoc network 610, the devices 602, 604, 606 and 608 can all communicate with each other in a "peer-to-peer" style of communication, for example. Furthermore, devices may join and/or leave the network 610, and the network 610 will automatically reconfigure itself without needing the user to reconfigure the network 610. While an Ad-Hoc network is referenced in FIG. 6, it is understood that a playback network may be based on a type of network that is completely or partially different from an Ad-Hoc network.

Using the Ad-Hoc network 610, the devices 602, 604, 606, and 608 can share or exchange one or more audio sources and be dynamically grouped to play the same or different audio sources. For example, the devices 602 and 604 are grouped to playback one piece of music, and at the same time, the device 606 plays back another piece of music. In other words, the devices 602, 604, 606 and 608, as shown in FIG. 6, form a HOUSEHOLD that distributes audio and/or reproduces sound. As used herein, the term HOUSEHOLD (provided in uppercase letters to disambiguate from the user's domicile) is used to represent a collection of networked devices that are cooperating to provide an application or service. An instance of a HOUSEHOLD is identified with a household 610 (or household identifier), though a HOUSEHOLD may be identified with a different area or place.

In certain embodiments, a household identifier (HHID) is a short string or an identifier that is computer-generated to help ensure that it is unique. Accordingly, the network 610 can be characterized by a unique HHID and a unique set of configuration variables or parameters, such as channels (e.g., respective frequency bands), service set identifier (SSID) (a sequence of alphanumeric characters as a name of a wireless network), and WEP keys (wired equivalent privacy or other security keys). In certain embodiments, SSID is set to be the same as HHID.

In certain embodiments, each HOUSEHOLD includes two types of network nodes: a control point (CP) and a zone player (ZP). The control point controls an overall network setup process and sequencing, including an automatic generation of required network parameters (e.g., WEP keys). In an embodiment, the CP also provides the user with a HOUSEHOLD configuration user interface. The CP function can be provided by a computer running a CP application module, or by a handheld controller (e.g., the controller 308) also running a CP application module, for example. The zone player is any other device on the network that is placed to participate in the automatic configuration process. The ZP, as a notation used herein, includes the controller 308 or a computing device, for example. In some embodiments, the functionality, or certain parts of the functionality, in both the CP and the ZP are combined at a single node (e.g., a ZP contains a CP or vice-versa).

In certain embodiments, configuration of a HOUSEHOLD involves multiple CPs and ZPs that rendezvous and establish a known configuration such that they can use a standard networking protocol (e.g., IP over Wired or Wireless Ethernet) for communication. In an embodiment, two types of networks/protocols are employed: Ethernet 802.3 and Wireless 802.11g. Interconnections between a CP and a ZP can use either of the networks/protocols. A device in the system as a member of a HOUSEHOLD can connect to both networks simultaneously.

In an environment that has both networks in use, it is assumed that at least one device in a system is connected to both as a bridging device, thus providing bridging services between wired/wireless networks for others. The zone player 606 in FIG. 6 is shown to be connected to both networks, for example. The connectivity to the network 612 is based on Ethernet and/or Wireless, while the connectivity to other devices 602, 604 and 608 is based on Wireless and Ethernet if so desired.

It is understood, however, that in some embodiments each zone player 606, 604, 602 may access the Internet when retrieving media from the cloud (e.g., the Internet) via the bridging device. For example, zone player 602 may contain a uniform resource locator (URL) that specifies an address to a particular audio track in the cloud. Using the URL, the zone player 602 may retrieve the audio track from the cloud, and ultimately play the audio out of one or more zone players.

VI. Example System Configuration

Figure 7:
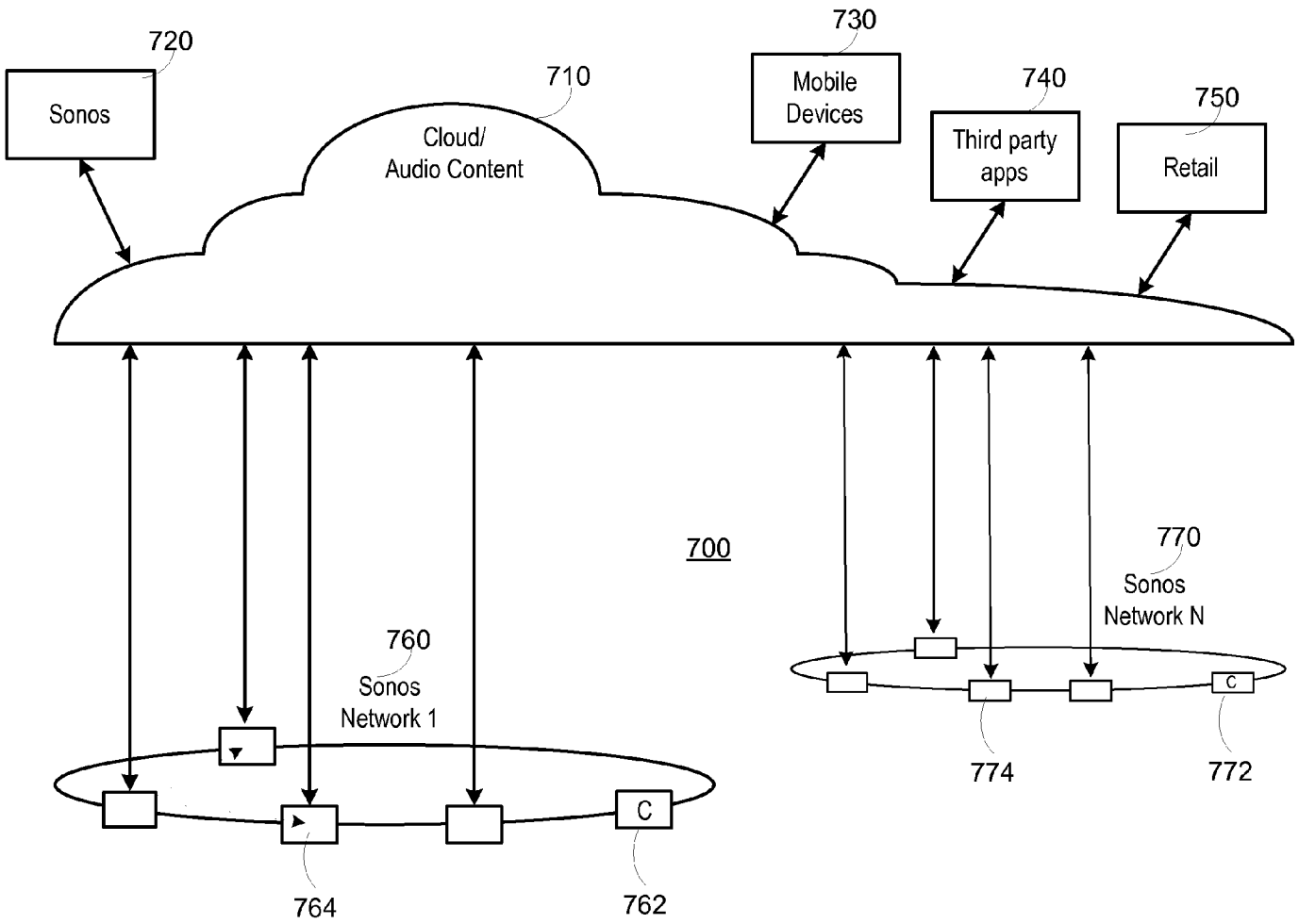
FIG. 7 shows a system including a plurality of networks including a cloud-based network and at least one local playback network.

FIG. 7 shows a system including a plurality of networks including a cloud-based network and at least one local playback network. A local playback network includes a plurality of playback devices or players, though it is understood that the playback network may contain only one playback device. In certain embodiments, each player has an ability to retrieve its content for playback. Control and content retrieval can be distributed or centralized, for example. Input can include streaming content provider input, third party application input, mobile device input, user input, and/or other playback network input into the cloud for local distribution and playback.

As illustrated by the example system 700 of FIG. 7, a plurality of content providers 720-750 can be connected to one or more local playback networks 760-770 via a cloud and/or other network 710. Using the cloud 710, a multimedia playback system 720 (e.g., Sonos™), a mobile device 730, a third party application 740, a content provider 750 and so on can provide multimedia content (requested or otherwise) to local playback networks 760, 770. Within each local playback network 760, 770, a controller 762, 772 and a playback device 764, 774 can be used to playback audio content.

VII. Example Multiple Transducer Playback Devices

In multiple transducer playback devices, such as, for example, a playback device including at least one tweeter and at least one woofer (e.g., the example playback device 200), the placement and configuration of the transducers impacts the overall playback experienced by the listener. The sound waves output by each transducer may interact with the environment (e.g., may be absorbed by a noise baffle, may be reflected off a solid wall, etc.) and may also interact with the other transducers of the playback device. For example, the physical structure of the woofer may interact with the sound waves output by the tweeter. While sound waves output from a tweeter may travel (or radiate) in all directions due to broad dispersion or low directivity (e.g., "omni-directional"), in some examples, lower frequency wave components of the sound waves output from the tweeter may travel substantially horizontal relative to the surface of the playback device and towards the woofer. Furthermore, sound waves traveling along (or substantially near) the surface of the playback device may bend (or wrap) accordingly as the sound waves pass an edge. This phenomenon is similar to how a person can hear somebody shouting while standing around a corner from the shouter.

As the lower frequency wave components of the audio output (or sound waves) from the tweeter reach the woofer, the tweeter output experiences significant reflections and frequency response issues. For example, a playback device may include a raised tweeter (in relation to a woofer), resulting in a "lip" or "step" between the tweeter and the woofer. As a result, some components of the sound waves output from the tweeter will travel at a downward angle towards the woofer and/or travel along (or substantially near) the surface of the playback device towards the woofer (e.g., the sound wave will travel (or bend) over the "lip" or "step"). To try to lessen this interference, some playback devices position the tweeter relatively close to the woofer. This positioning, however, places the tweeter close to the cavity of the woofer cone resulting in interference patterns or diffraction due to the dip or notch from the cavity. In some other examples, a flat front woofer is used to try to avoid frequency response dips caused by the cavity of most traditional cone speakers. However, while the flat front woofer may eliminate (or substantially reduce) the interference due to any step or dip, other issues, such as Doppler distortion or intermodulation distortion (IMD), may continue to affect the frequency response of the tweeter. Additionally, it is challenging to design a sufficiently stiff woofer cone that does not break up, but still maintains low mass. To prevent flat cone woofers from vibrating like a drum head, most flat cone woofers are made stiff, but are relatively heavy.

VIII. Example Acoustic Grille

Figure 8:
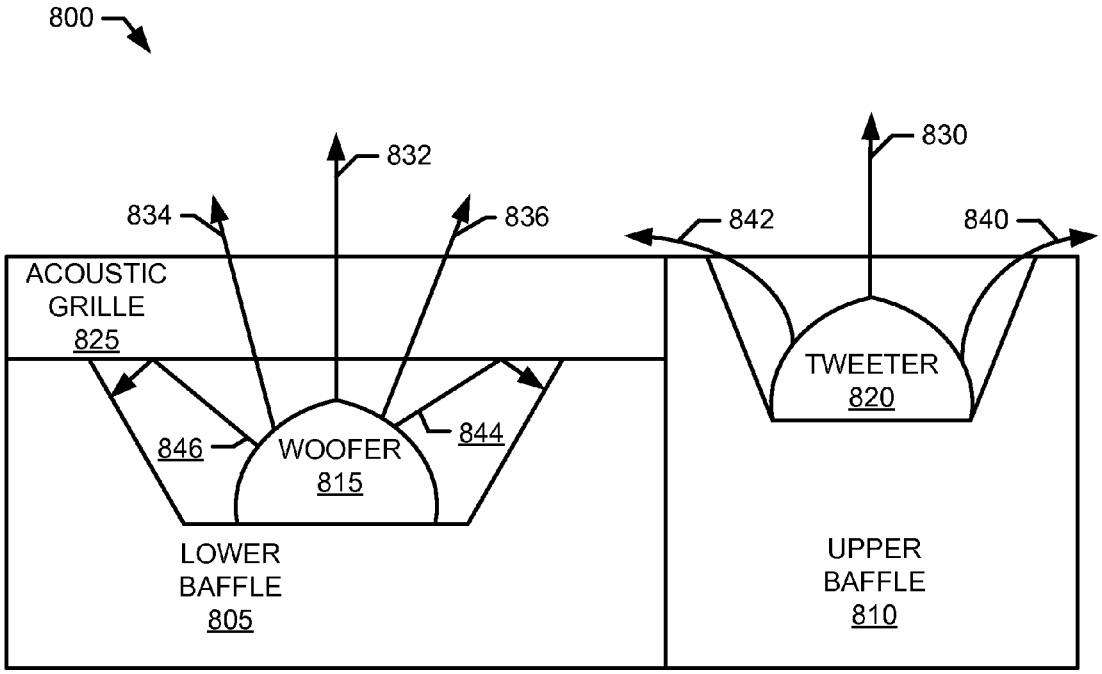
FIG. 8 illustrates a profile view of an example playback device including an example acoustic grille.
Figure 9:
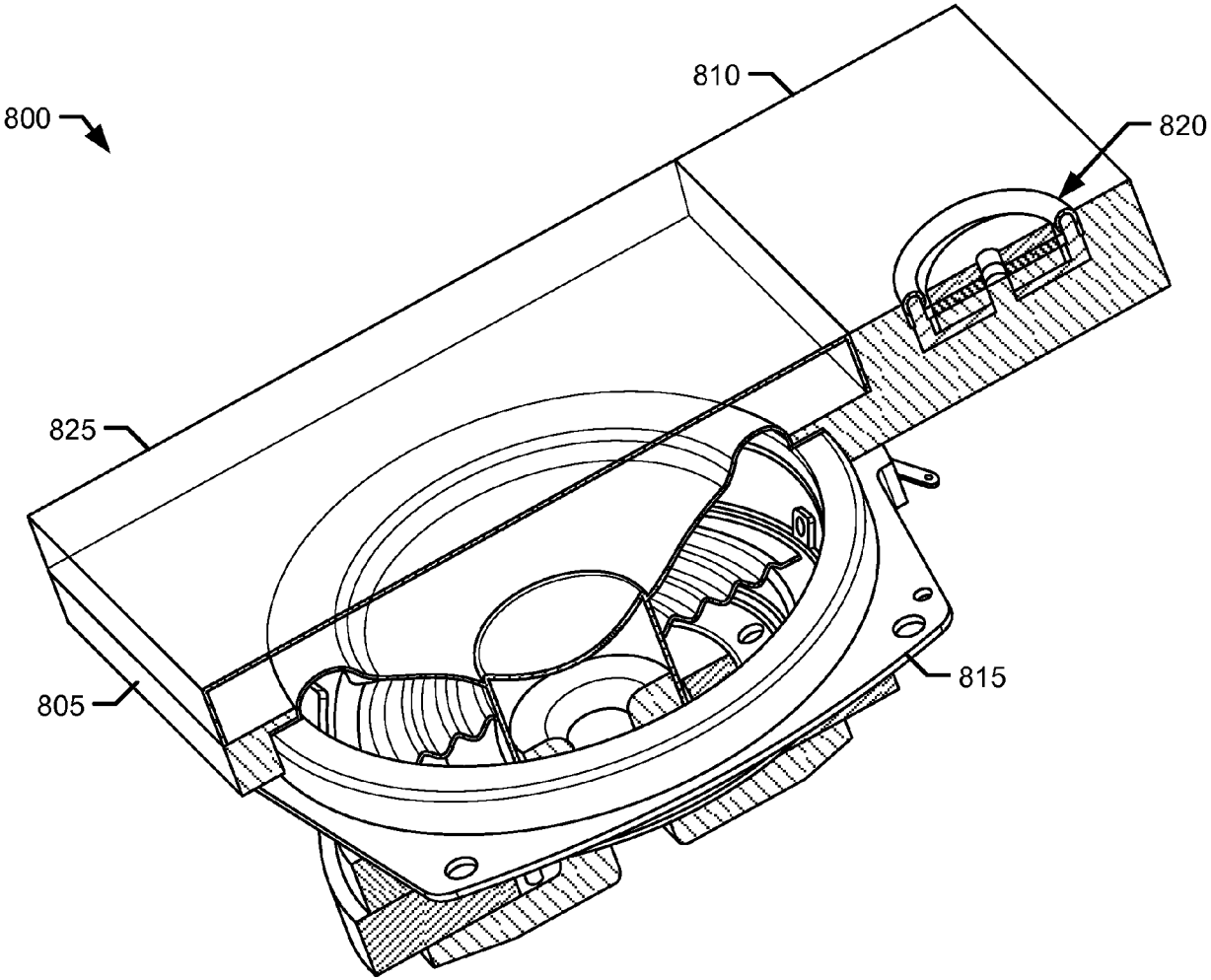
FIG. 9 illustrates an angled view of the example playback device including the example acoustic grille.

FIG. 8 illustrates a profile view of an example playback device 800 including an example acoustic grille 825. FIG. 9 illustrates an angled view of the example playback device 800 including the example acoustic grille 825. The example playback device 800 includes an example lower baffle 805 and an example upper baffle 810. In some examples, the lower baffle 805 and the upper baffle 810 is comprised of a single baffle. In the illustrated example, an example woofer 815 is mounted to the face of the example lower baffle 805 and an example tweeter 820 is mounted to the face of the example upper baffle 810. The example upper baffle 810 in FIG. 8 is raised in relation to the example lower baffle 805 resulting in a "step" or other change in contour (e.g., a curved "lip" or "dip") from the surface of the example lower baffle 805 to the surface of the example upper baffle 810. The example acoustic grille 825 is positioned on top of (or substantially flush with) the example lower baffle 805 and covers the example woofer 815. For example, the acoustic grille 825 may be placed directly on top of the lower baffle 805 or may be separated by, for example, a spacer but still effectively affect any or all sound waves received or output by the transducer (e.g., the example woofer 815) mounted in the lower baffle 805. In the illustrated example, the acoustic grille 825 is positioned adjacent to the upper baffle 810 and removes the step between the upper baffle 810 and the lower baffle 805. However, other positioning arrangements are possible. For example, the acoustic grille 825 may be positioned to cover the lower baffle 805 and the upper baffle 810.

As described above, audio output from a transducer (e.g., a speaker) includes a plurality of wave components. Each of these wave components is traveling in a different direction from the transducer. In the illustrated example of FIG. 8, higher frequency wave components of an audio wave (or sound wave) are output at an angle substantially perpendicular (e.g., at or effectively near a perpendicular angle) to the surface of the example playback device 800 (e.g., the example wave components 830, 832, 834 and 836). Conversely, lower frequency wave components of the audio wave output at an angle relatively horizontal to the surface of the example playback device 800 (e.g., the example wave components 840, 842, 844 and 846). As described above, these wave components can be affected by the physical structure of the playback device 800. In the illustrated example, the wave components 840 and 842 bend along the face of the upper baffle 810. In some examples, wave components may bend (or change the direction of travel) and travel along the face of the lower baffle 805 and/or into the cavity created by a recessed woofer 815.

In the illustrated example, the acoustic grille 825 is a variable-acoustic-opacity grille. In other words, the example acoustic grille 825 does not interact uniformly with received wave components. For example, the acoustic grille 825 is acoustically transparent (or open) to higher angle of incidence wave components relative to the surface of the acoustic grille 825. For instance, the example wave components 832, 834 and 836 pass through the example acoustic grille 825. In contrast, the example acoustic grille 825 is acoustically solid (e.g., opaque) to lower angle incidence wave components relative to the surface of the acoustic grille 825. For example, rather than passing through the acoustic grille 825, the wave components 844 and 846 reflect off the acoustic grille 825. In some examples when wave components from the tweeter 820 bend towards the woofer 815 (e.g., the example wave component 842), the wave components are blocked from continuing in that direction of travel and reflect off the surface of the acoustic grille 825.

In the illustrated example, the acoustic grille 825 may be composed of any material having properties that allow a portion of the sound wave to pass through the material (e.g., higher angle of incidence wave components) while blocking and/or reflecting a portion of the sound wave from passing through the material (e.g., lower angle of incidence wave components). For example, the acoustic grille 825 may be composed of small-cell reticulated foam. In some examples, the surface of the acoustic grille 825 may be a porous surface. However, other foamed plastics or materials may also be used. For example, the acoustic grille 825 may include a wired frame covered by a cloth with similar properties of allowing higher angle of incidence wave components to pass through and blocking/reflecting lower angle of incidence wave components. In some examples, the acoustic grille 825 may be designed with a threshold angle to determine higher angle and lower angle of incidence wave components. For example, all wave components with an angle of incidence relative to the surface of the acoustic grill 825 less than ten degrees may be blocked from passing through the material.

By using the acoustic grille 825 in a multiple transducer playback device (e.g., the example playback device 800), most of the interference issues between transducers can be eliminated (or substantially reduced/constrained). For example, an acoustic grille 825 positioned on top of the multiple transducers may completely prevent or stop interference between the multiple transducers or may effectively prevent the sound waves from interfering with each other (e.g., substantially constrain interference). For example, when a raised tweeter 820 is used in a playback device 800 (e.g., the top of the dome of the tweeter 820 is raised above the face of the upper baffle 810), lower frequency wave components may output in the direction of the woofer 815. However, the example acoustic grille 825 blocks lower frequency wave components that also have a low angle of incidence relative to the surface of the acoustic grille 825. As a result, in some examples, low-angle (or low directivity) waveguides for the example tweeter 820 are used to increase the area of improved sound quality in the listening area (e.g., an increased sweet spot). This is in contrast to reducing the sweet spot by using a waveguide to prevent sound waves from the tweeter radiating towards the woofer.

While the illustrated examples of FIGS. 8 and 9 relate to the bottom of an example acoustic grille 825 interacting with wave components output from a transducer (e.g., the example tweeter 820, the example woofer 815), the example acoustic grille 825 functions similarly when sound waves interact with the top or any of the other surfaces of the acoustic grille 825. For example, lower angle of incidence wave components of the sound waves are blocked from passing through the acoustic grille 825 and into the woofer 815. Thus, the example acoustic grille 825 diffuses external noise sources as well.

Figure 10:
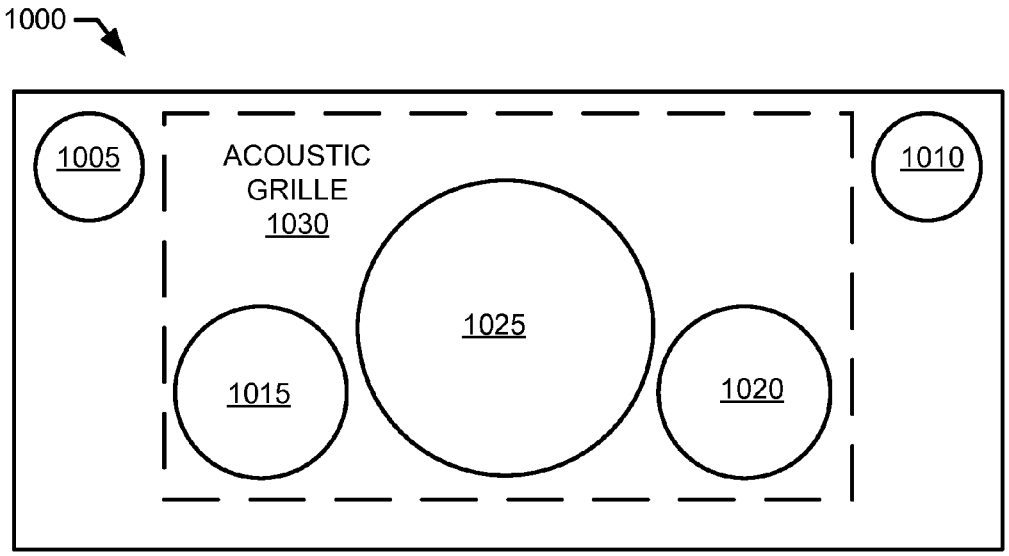
FIG. 10 is an illustrated example of a playback device including first and second example tweeters, first and second example mid-range drivers and an example low-range woofer.
Figure 11:
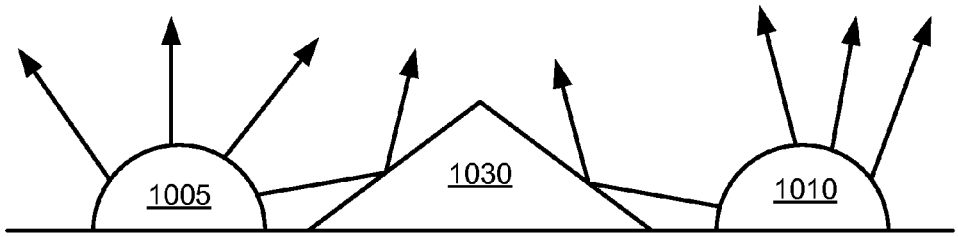
FIG. 11 illustrates a profile view of the example playback device, the first and second example tweeters and the example acoustic grille.

FIG. 10 is an illustrated example of a playback device 1000 including first and second example tweeters 1005 and 1010, first and second example mid-range drivers 1015 and 1020 and an example low-range woofer 1025. In the illustrated example, the mid-range drivers 1015 and 1020 and the low-range woofer 1025 are covered by an example acoustic grille 1030. FIG. 11 illustrates a profile view of the example playback device 1000, the first and second example tweeters 1005 and 1010 and the example acoustic grille 1030. As described above, lower angle of incidence wave components output from any of the example transducers 1005, 1010, 1015, 1020 and/or 1025 are blocked/reflected and, thus, do not interact with the other example transducers 1005, 1010, 1015, 1020 and/or 1025.

In the illustrated example of FIG. 11, the acoustic grille 1030 includes angled edges. As a result of the angled edges, the example acoustic grille 1030 improves left and right separation of the audio output from the first and second example tweeters 1005 and 1010. In other words, the angled edges of the example acoustic grille 1030 stop (or substantially prevent) left channel audio output from crossing over to the right side of a listener, and vice versa. For example, the acoustic grille 1030 may completely stop left channel audio output crossover or may effectively prevent a crossover effect from being noticed by a listener (e.g., substantially prevent crossover).

In another example, one or more transducers may be positioned behind an acoustic grille and receive sound waves from an outside source. For example, an acoustic grille may be disposed atop an array of transducers (e.g., microphones). When, for example, an audio source outputs sound waves (e.g., a person speaking) towards the array of transducers, the acoustic grille receives sound waves at varying angles. However, as the acoustic grille filters sound waves received at relatively lower angles of incidence, the sound waves that pass through the acoustic grille indicate the general direction of the audio source. For example, monitoring the level measurements of the transducers (e.g., sound pressure level, electrical signal output, etc.), and identifying the angles of incidence of the sound waves that pass through the acoustic grille can be used to determine the location of the audio source.

In another example, a playback device may include input transducers (e.g., microphones) and output transducers (e.g., speakers). In some such examples, the input transducers can identify the location of a user in the room (or if no user is in the room) and the characteristics of the output transducers may adjust accordingly. For example, the output transducers may automatically reduce the sound levels if no user is identified in the room. Alternatively, the output transducers may automatically increase the sound levels if no user is identified in the room. In other examples, the sound characteristics of the individual output transducers may automatically adjust based on the location of a user in the room. For example, if a user is identified in a corner of the room, the gain or sound levels of the individual output transducers may change to continue providing the best overall playback experienced by the user.

Figure 12:
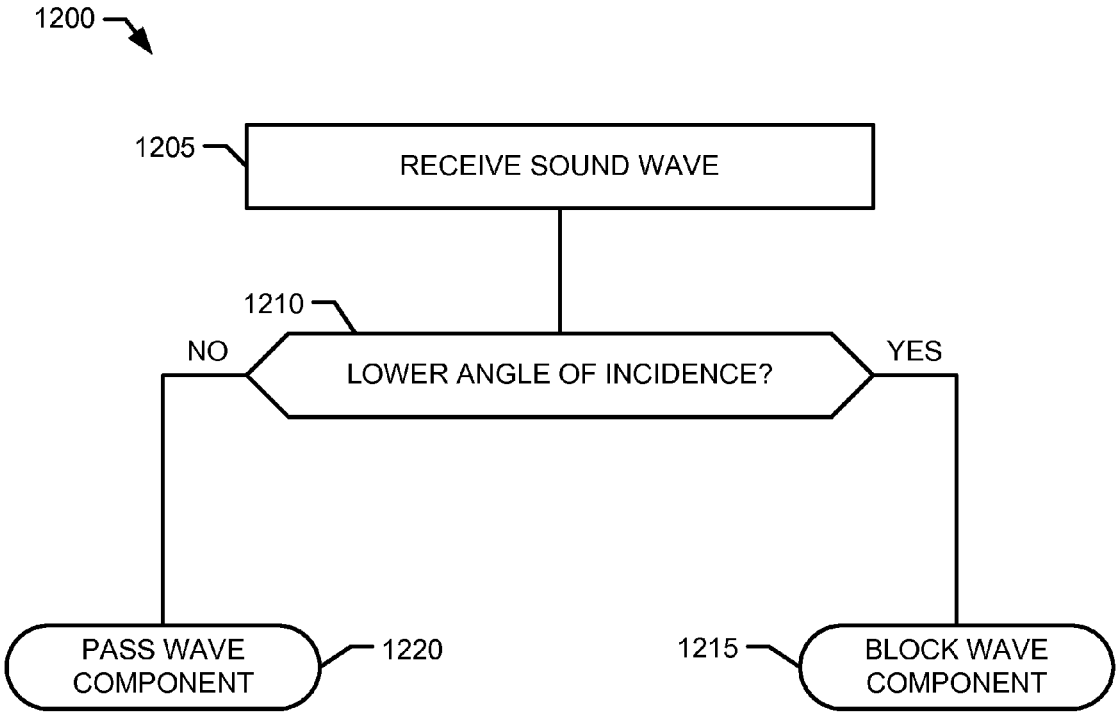
FIG. 12 is a flowchart representative of an example process to optimize acoustics in a multiple transducer playback device.

A flowchart representative of an example process 1200 to optimize acoustics in a multiple transducer playback device is shown in FIG. 12. The example process 1200 begins at block 1205 when the example acoustic grille 825 of FIG. 8 receives a sound wave. For example, the playback device 800 processes an audio input and outputs a sound wave via a transducer (e.g., a speaker). In the illustrated example, wave components of the sound wave radiating (or output) from the transducer (e.g., the example tweeter 820) are received by the acoustic grille 825 at a plurality of angles of incidence relative to the surface of the acoustic grille 825. At block 1210, if the example acoustic grille 825 receives a lower angle of incidence wave component, then, at block 1215, the acoustic grille 825 blocks the wave component. For example, the wave component may be a lower frequency wave component output from the example tweeter 820. In some such examples, the wave component may travel along (or substantially near) the surface of the playback device 800 and travel towards the example woofer 815. As a result, the example acoustic grille 825 blocks (or reflects) the wave component to prevent (or nearly eliminate or constrain) interference issues due to the wave component output from the example tweeter 820. The process 1200 then ends.

Returning to block 1210, if the wave component has a higher angle of incidence relative to the surface of the acoustic grille 825, then, at block 1220, the wave component passes through the acoustic grille 825. In some examples, the properties of the acoustic grille 825 include a threshold angle. When the wave component angle of incidence is less than the threshold angle, the wave component is blocked from passing through the acoustic grille 825. In some examples when the wave component angle of incidence is greater than the threshold angle, the wave component passes through the acoustic grille 825. The process 1200 then ends.

Figure 13:
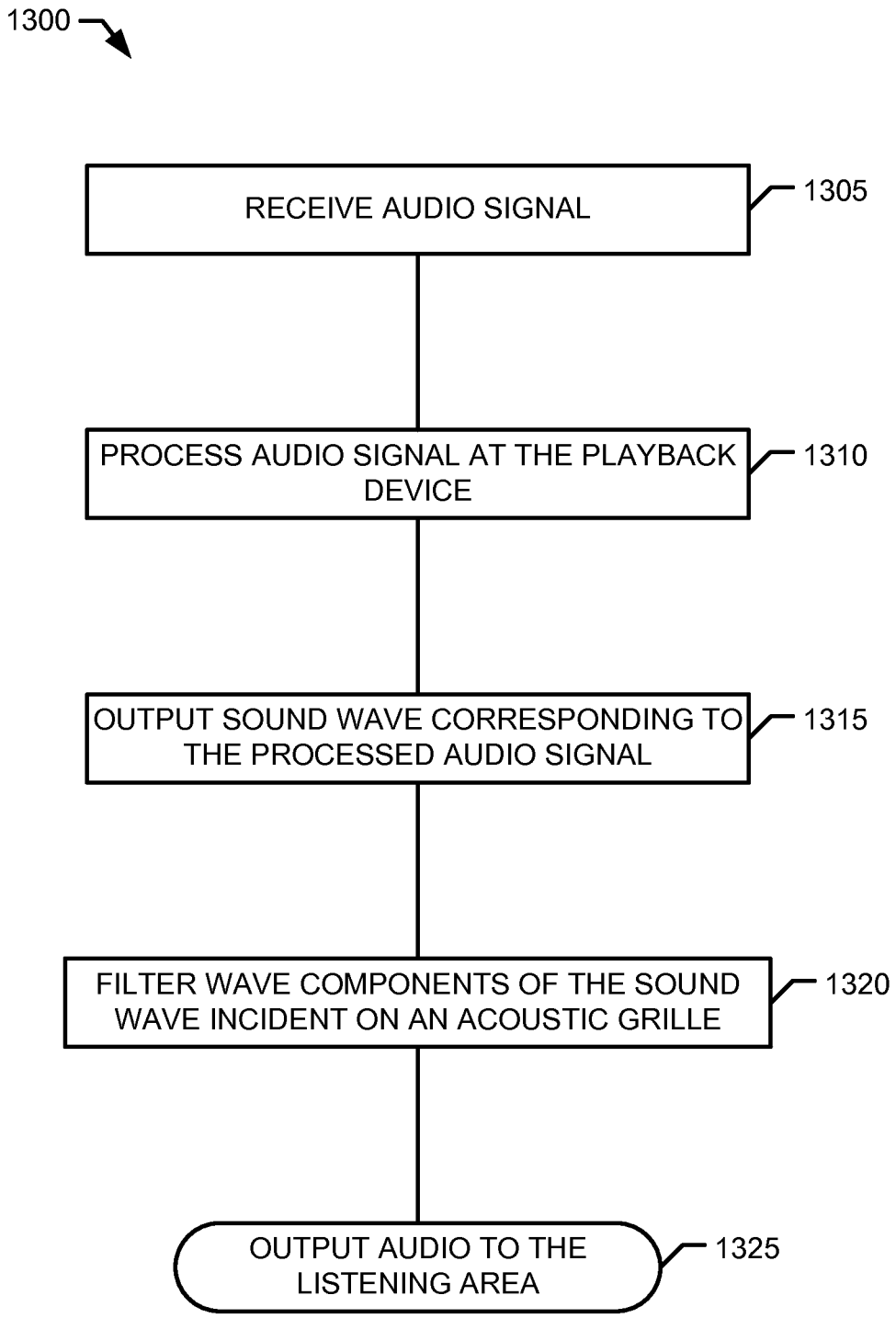
FIG. 13 is a flowchart representative of another example process to optimize acoustical output in a multiple transducer playback device.

FIG. 13 is a flowchart representative of another example process 1300 to optimize acoustical output in a multiple transducer playback device. The example process 1300 begins at block 1305 when the example playback device 800 receives an audio signal. For example, the playback device 800 may receive audio from another playback device via the network interface 402, may retrieve the audio from an audio source (e.g., the cloud, a networked-attached storage, etc.). At block 1310, the audio signal is processed at the playback device. For example, the audio processing component 412 may adjust the gain of the example woofer 815. In some examples, the audio processing component 412 may adjust equalization settings of the drivers based at least in part on the characteristics of the audio signal (e.g., left and right audio channels), the characteristics of the listening area, etc. For example, the audio processing component 412 may receive information (via a sensor such as a camera) regarding the position of a listener in the room. In some such examples, the audio processing component 412 may adjust characteristics of the audio signal to direct the audio towards the position of the listener.

At block 1315, a sound wave corresponding to the processed audio signal is output. For example, the processed audio signal may be provided to the example audio amplifier 416 to output via the woofer 815 and tweeter 820. In the illustrated example, wave components of the sound wave radiate outwards from the drivers in all directions.

As described above, some wave components may be altered at least in part on the physical transducer structure. For example, low frequency wave components from the tweeter may be modulated by the structure of the woofer cone and/or the up/down (e.g., "thumping") movement of the woofer. At block 1320, wave components of the sound wave incident on the acoustic grille 825 are filtered. For example, lower angle of incidence wave components of the first sound wave may be blocked by the acoustic grille 825. Additionally, higher angle of incidence wave components of the sound wave may pass through the acoustic grille 825. The process ends at block 1325 when the audio is output from the playback device 800 to the listening area. In the illustrated example, a portion of the sound wave (e.g., higher angles of incidence wave components) is output to be experienced by the listener.

IX. Conclusion

As discussed above, apparatus and methods are provided to optimize acoustics in a multiple transducer playback device. The embodiments described herein provide and/or use an acoustic grill to filter wave components of a sound wave so that only a portion of the wave components pass through the acoustic grill. The embodiments described herein may also be used to selectively reflect wave components of sound waves to prevent the sound waves from crossing each other.

An example embodiment includes a playback device having a first transducer to at least one of output sound waves and receive sound waves, and a second transducer to at least one of output sound waves and receive sound waves, where the second transducer is positioned adjacent to the first transducer. The example playback device also includes an acoustic grille positioned in relation to the first transducer, and the acoustic grille is to reflect sound waves received at a first angle of incidence. In some examples, the acoustic grille is to pass through sound waves that are received at a second angle of incidence. In some such examples, the acoustic grille is to include a threshold angle of incidence, where the first angle of incidence is less than the threshold angle. In some examples, the second angle of incidence is greater than the threshold angle. In some examples, the acoustic grille is positioned on the first transducer. In some such examples, the acoustic grille is positioned substantially flush with a baffle of the second transducer. In some such examples, the position of the acoustic grille is to constrain sound wave interference between the first transducer and the second transducer. In some examples, the acoustic grille is positioned between the first transducer and the second transducer. In some such examples, the position of the acoustic grille is to improve sound wave separation between the first transducer and the second transducer. In some examples, if the first transducer receives sound waves and the second transducer at least outputs sound waves, the acoustic grille is to reflect the output sound waves from being received by the first transducer.

Another example embodiment includes a method of adjusting a sound wave having at least a first wave component and a second wave component. The example method includes receiving the first wave component at an acoustic grille at a first angle of incidence, where the acoustic grille is positioned in relation to a plurality of transducers. In some examples, the method further includes receiving a second wave component at the acoustic grille at a second angle of incidence. In some examples, the method further includes reflecting the first wave component based on the first angle of incidence. In some examples, the method further includes passing through the second wave component based on the second angle of incidence, where the first angle of incidence is less than a threshold angle. In some examples, the second angle of incidence is greater than the threshold angle. In some examples, the acoustic grille is positioned on top of the plurality of transducers. In some such examples, the acoustic grille reduces sound wave interference between the plurality of transducers. In some examples, a portion of the plurality of transducers receive sound wave components pass through the acoustic grille. In some examples, a sound wave source location is identified based on the portion of the plurality of transducers. In some examples, the acoustic grille is positioned between one or more of the plurality of transducers. In some such examples, the acoustic grille improves sound wave separation between the one or more of the plurality of transducers.

Another example embodiment includes a playback device including a first baffle, a second baffle and an acoustic grille. In some examples, the first baffle includes a first transducer and a first surface opposite a second surface, where the first transducer is mounted in the first surface. In some examples, the second baffle is positioned adjacent to the first baffle, and the second baffle includes a second transducer and a third surface opposite a fourth surface, and wherein the second transducer is mounted in the third surface. In some examples, the distance between the third surface and the fourth surface is different than the difference between the first surface and the second surface. In some examples, the acoustic grille is positioned on top of the first baffle and is positioned substantially flush to the second baffle. In some examples, the acoustic grille is to reflect sound waves received at a first angle of incidence and is to pass through sound waves received at a second angle of incidence, where the position of the acoustic grille is to substantially constrain sound wave interference between the first transducer and the second transducer. In some examples, the position of the acoustic grille is to improve sound wave separation between the first transducer and the second transducer.

The description discloses various example systems, methods, apparatus, and articles of manufacture including, among other components, firmware and/or software executed on hardware. However, such examples are merely illustrative and should not be considered as limiting. For example, it is contemplated that any or all of these firmware, hardware, and/or software components can be embodied exclusively in hardware, exclusively in software, exclusively in firmware, or in any combination of hardware, software, and/or firmware. Accordingly, while the following describes example systems, methods, apparatus, and/or articles of manufacture, the examples provided are not the only way(s) to implement such systems, methods, apparatus, and/or articles of manufacture.

Additionally, reference herein to "embodiment" means that a particular feature, structure, or characteristic described in connection with the embodiment can be included in at least one example embodiment of the invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible medium such as a memory, DVD, CD, Blu-ray, and so on, storing the software and/or firmware.

I claim:

1. A playback device comprising:

a transducer;

an acoustic grille;

a speaker;

a network interface;

a processor; and a computer readable medium comprising instructions that, when executed by the processor, cause the playback device to at least:

receive, via the transducer, a sound wave passed through the acoustic grille, wherein the received sound wave is output by an audio source outside of the playback device;

determine an angle of incidence of the sound wave that passes through the acoustic grille, wherein the angle of incidence is determined based on an angle of reflection of the acoustic grille;

adjust an output characteristic of the speaker based on the determined angle of incidence;

receive, via the network interface, an audio signal; and play back, via the speaker, the audio signal according to the adjusted output characteristic of the speaker.

2. The playback device of claim 1, wherein the transducer is mounted in a baffle, and wherein the acoustic grille is positioned substantially flush with the baffle.

3. The playback device of claim 2, wherein the speaker is mounted in the baffle.

4. The playback device of claim 1, wherein the instructions, when executed by the processor, cause the playback device to determine the angle of incidence of the sound wave based on a level of the received sound wave.

5. The playback device of claim 4, wherein the level of the received sound wave comprises at least a sound pressure level or a level of an electrical signal output by the transducer.

6. The playback device of claim 1, wherein the instructions, when executed by the processor, cause the playback device to determine, based on the angle of incidence of the received sound wave, a location of a source of the sound wave.

7. The playback device of claim 6, wherein the instructions, when executed by the processor, cause the playback device to adjust the output characteristic of the speaker based on the location of the source of the sound wave.

8. The playback device of claim 6, wherein the instructions, when executed by the processor, cause the playback device to determine the location of the source of the sound wave by determining a location of a user relative to the playback device.

9. The playback device of claim 8, wherein the instructions, when executed by the processor, cause the playback device to adjust the output characteristic of the speaker to direct the play back of the audio signal towards the location of the user.

10. The playback device of claim 1, wherein the adjusted output characteristic of the speaker comprises a sound output level.

11. The playback device of claim 1, wherein the adjusted output characteristic of the speaker comprises an equalization setting.

12. The playback device of claim 1, wherein the transducer is mounted in a baffle, the acoustic grille is positioned substantially flush with the baffle, and the speaker is positioned outside of the baffle.

13. The playback device of claim 12, wherein the acoustic grille is to reflect sound waves output by the speaker and the reflected sound waves are not received by the transducer.

14. A method comprising:

receiving, via a transducer of a playback device, a sound wave passed through an acoustic grille of the playback device, wherein the received sound wave is output by an audio source outside of the playback device;

determining an angle of incidence of the sound wave that passes through the acoustic grille, wherein the angle of incidence is determined based on an angle of reflection of the acoustic grille;

adjusting an output characteristic of the speaker based on the determined angle of incidence;

receiving, via a network interface of the playback device, an audio signal; and playing back, via a speaker of the playback device, the audio signal according to the adjusted output characteristic of the speaker.

15. The method of claim 14, wherein determining the angle of incidence of the sound wave comprises determining a level of the received sound wave.

16. The method of claim 14 further comprising determining a location of a source of the sound wave based on the angle of incidence, the location of the source of the sound wave relative to the playback device.

17. The method of claim 16 further comprising adjusting the output characteristic of the speaker based on the determined location of the source of the received sound wave relative to the playback device.

18. The method of claim 16 further comprising directing the play back of the audio signal towards a user by:

determining a location of the user relative to the playback device; and directing the play back of the audio signal towards the location of the user by adjusting the output characteristic of the speaker.

19. The method of claim 14, wherein the adjusted output characteristic of the speaker comprises at least a sound output level or an equalization setting.

20. A computer readable medium storing instructions that, when executed, cause a processor to at least:

receive, via a transducer of a playback device, a sound wave passed through an acoustic grille of the playback device, wherein the received sound wave is output by an audio source outside of the playback device;

determine an angle of incidence of the sound wave that passes through the acoustic grille, wherein the angle of incidence is determined based on an angle of reflection of the acoustic grille;

adjust an output characteristic of the speaker based on the angle of incidence, wherein the adjusted output characteristic of the speaker comprises at least a sound output level or an equalization setting;

receive, via a network interface of the playback device, an audio signal; and play back, via a speaker of the playback device, the audio signal according to the adjusted output characteristic of the speaker.

* * * * *